United States Patent [19]

Kurihara

[11] 4,430,965

[45] Feb. 14, 1984

[54] THROTTLE OPENER FOR CARBURETORS

[75] Inventor: Noriyuki Kurihara, Hamamutsu, Japan

[73] Assignee: Yamaha Hatsudoki Kabushiki Kaisha, Iwata, Japan

[21] Appl. No.: 264,057

[22] Filed: May 15, 1981

[30] Foreign Application Priority Data

May 26, 1980 [JP] Japan ..... 55-70532

[51] Int. Cl.[3] ..... F02M 3/00

[52] U.S. Cl. ..... 123/328; 123/401

[58] Field of Search ..... 123/328, 320, 403, 401; 261/65, DIG. 19

[56] References Cited

U.S. PATENT DOCUMENTS 4,059,088 11/1977 Tateno et al. ..... 123/328

4,178,890 12/1979 Yamabe et al. ..... 123/320

FOREIGN PATENT DOCUMENTS 2272270 12/1975 France ..... 123/320

52-32429 3/1977 Japan ..... 261/DIG. 19

*Primary Examiner*—William A. Cuchlinski, Jr.

*Attorney, Agent, or Firm*—Ernest A. Beutler

[57] ABSTRACT

A throttle positioning device for prevent rapid closure of the throttle valve of an internal combustion engine under extreme decel conditions. The throttle control device includes a vacuum motor that is responsive to the pressure in the induction system at a point just slightly upstream of the throttle valve of the engine so that vacuum will be exerted on the vacuum motor when the throttle valve is substantially opened from its idle position and atmospheric pressure will be exerted when the throttle valve is closed toward its idle position. Various arrangements are provided for adjusting the rate of air flow between the vacuum motor and the intake passage in different directions.

9 Claims, 5 Drawing Figures

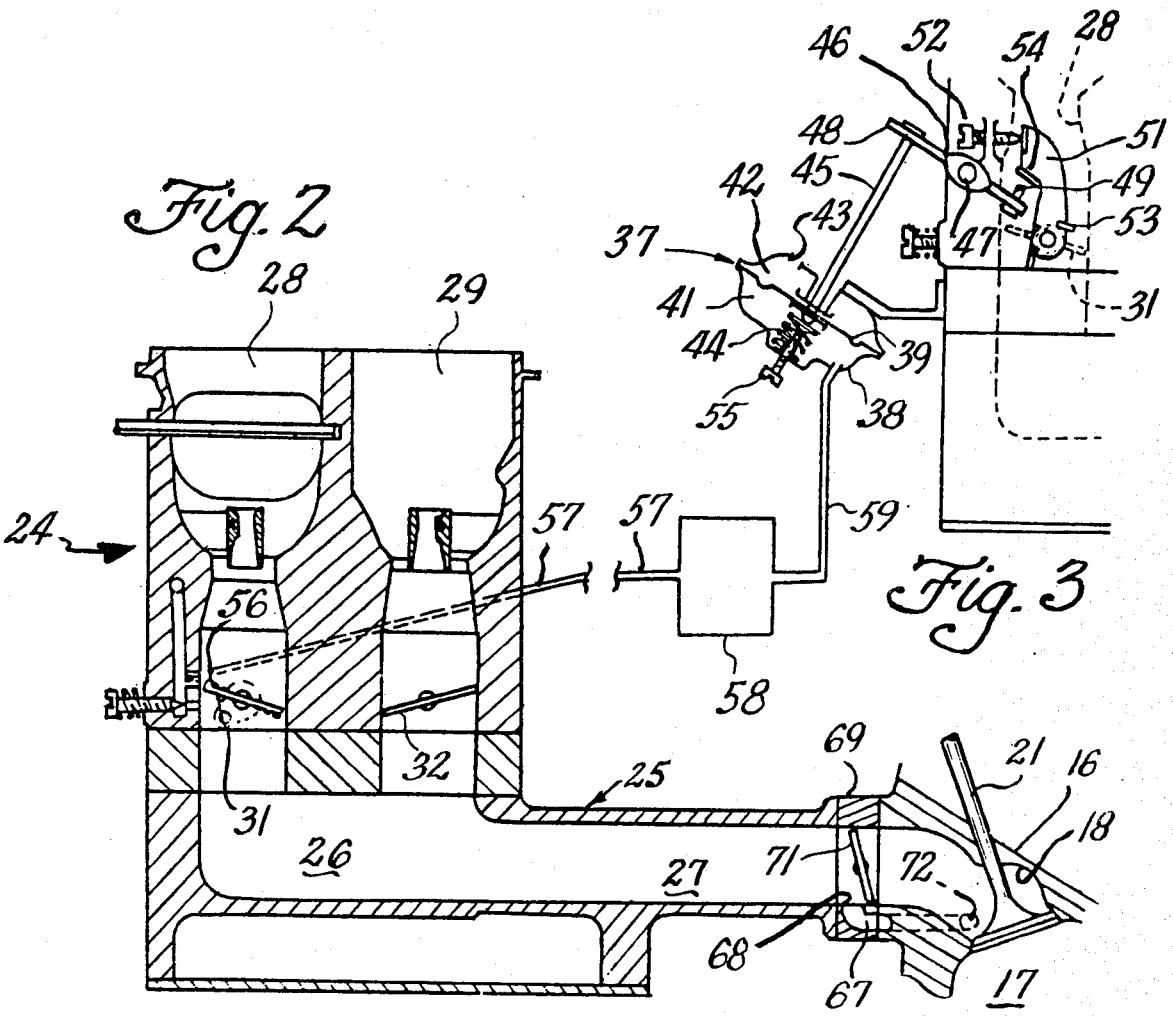
Fig. 2
Fig. 3
24
25
26
27
28
29
31
32
37
38
39
41
42
43
44
45
46
47
48
49
51
52
53
54
55
56
57
58
59
16
17
18
21
67
68
69
71
72
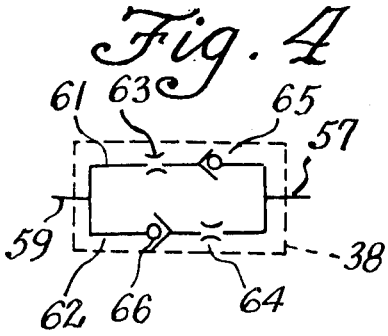
Fig. 4
61
63
65
57
59
38
62
66
64
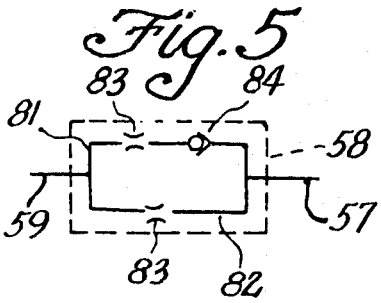
Fig. 5
83
84
81
58
59
57
83
82

THROTTLE OPENER FOR CARBURETORS

BACKGROUND OF THE INVENTION

This invention relates to a throttle opener for carburetors, and more particularly to an improved device for controlling the movement of a throttle valve of an engine on decel.

When the throttle valve of a vehicle powered by an internal combustion engine is suddenly closed, a high vacuum is exerted in the induction system. This high vacuum acts upon the fuel discharge circuits and tends to draw an overly rich mixture into the intake system under such running conditions. To avoid these difficulties, it has been proposed to provide a throttle positioning device which will either prevent or retard the complete closure of the throttle valve under such conditions. Such devices normally hold the throttle valve from reaching its fully closed or idle position for a period of time after the throttle valve has been suddenly closed. The prior art type of throttle positioning devices have normally employed a vacuum motor that is responsive to the intake vacuum downstream of the throttle valve. Thus, when the throttle valve is suddenly closed, a high vacuum will be exerted in the intake system and the vacuum motor is actuated so as to prevent full closure of the throttle valve. Such arrangements have, however, certain disadvantages. For example, if the throttle valve closure is delayed for too long a period of time, there will be substantially no engine braking. Also, such delayed closure will cause the engine to race under certain conditions. For example, if the throttle is rapidly opened and closed when the vehicle is not being driven, the action of the throttle positioner will cause over-revving of the engine.

In order to preclude these problems, it has been proposed to employ a device that is responsive to either vehicle speed, transmission condition or a combination of these factors which will override the operation of the throttle positioner. Such devices further complicate the overall system, add to its cost, and increase the likelihood of malfunction.

It is, therefore, a principal object of this invention to provide a throttle valve positioner which is more sensitive to actual engine conditions.

It is another object of this invention to provide a throttle valve positioner which retards the rate of closure of the throttle valve under sudden decelerations but which does not unduly delay the closing of the throttle valve and also which will not hold the throttle valve open under conditions in which such action is unnecessary.

SUMMARY OF THE INVENTION

This invention is adapted to be embodied in the throttle control device for an internal combustion engine having an induction passage and a throttle valve in the induction passage. The control device comprises a operating member that is moveable between a normal position and an operative position and which is operatively connected to the throttle valve wherein the throttle valve may be positioned in a partially opened position when the operating member is in its operative position. A vacuum motor responsive to subatmospheric pressure is operatively connected to the operating member for moving the operating member from its normal position to its operative position when a subatmospheric pressure is exerted on the vacuum motor. Means communicate the vacuum motor with a point in the induction passage that is upstream of the idle position of the throttle valve.

BRIEF DESCRIPTION OF THE DRAWINGS

FIG. 2 is a cross-sectional view of the engine shown in FIG. 1 showing in less schematic form the induction system.

FIG. 3 is a side elevational view showing the throttle positioner associated with the engine.

FIG. 4 is a schematic view of a control device that may be used in conjunction with the embodiment of FIGS. 1 through 3.

FIG. 5 is a schematic view of another form of control device.

DETAILED DESCRIPTION OF THE PREFERRED EMBODIMENTS

Figure 1:
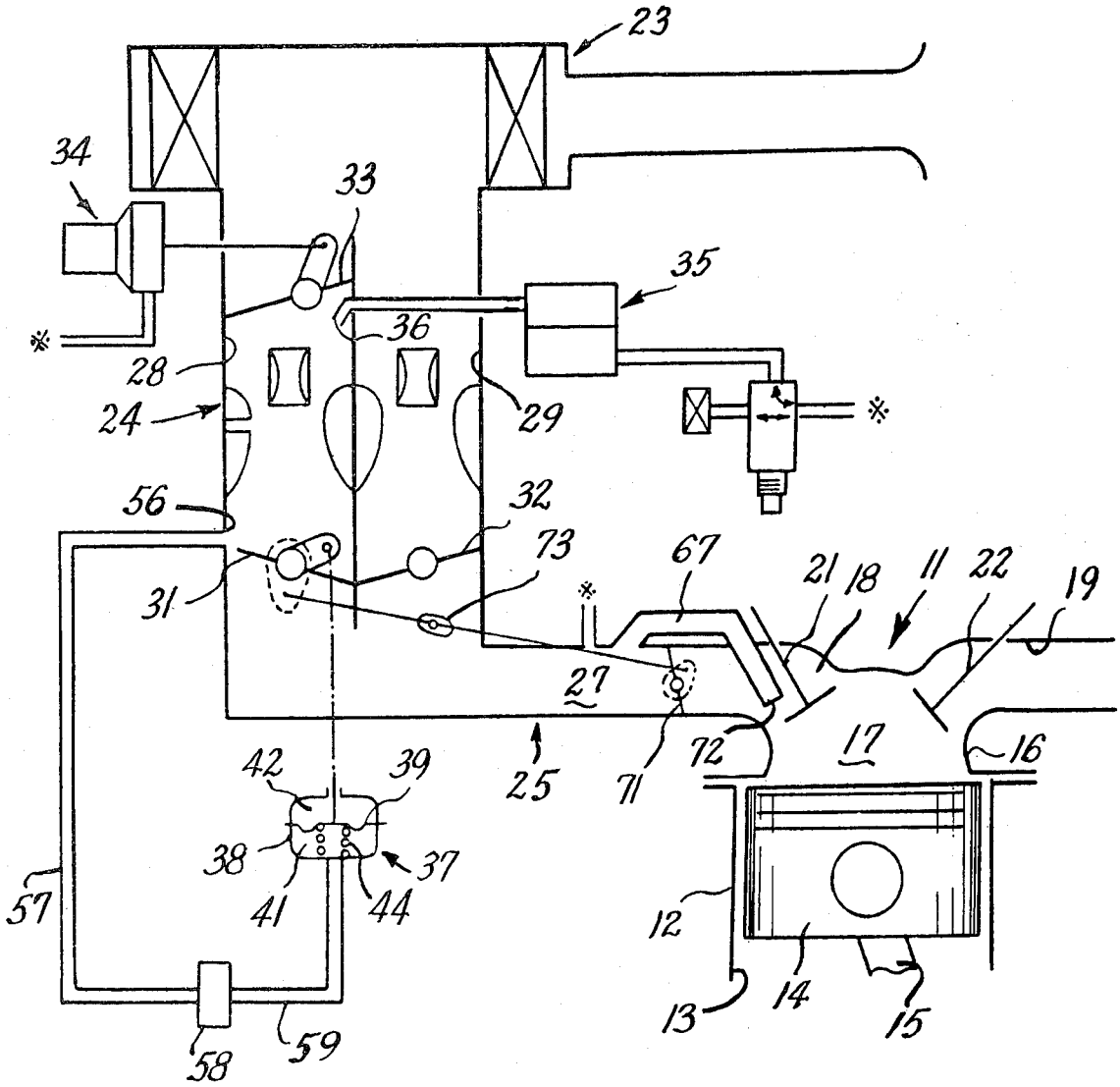
FIG. 1 is a partially schematic cross-sectional view taken through a single cylinder of an internal combustion engine embodying this invention.

An internal combustion engine embodying a throttle positioner constructed in accordance with an embodiment of this invention is identified generally by the reference numeral 11. The engine 11, except for the throttle positioner and its operation, is conventional and for that reason it has been illustrated schematically and only those portions necessary to understand the invention have been described and illustrated.

The engine 11 includes a cylinder block 12 having cylinder bores 13 which slideably support pistons 14. The pistons 14 are connected by means of connecting rods 15 to a crankshaft (not shown) in a known manner. A cylinder head 16 is affixed to the cylinder block 12 and has a plurality of cavities 17 that cooperate with the cylinder bores 13 and pistons 14 to form the combustion chambers.

The cylinder head 16 is formed with intake passages 18 that serve each of the chambers 17 and exhaust passages 19 which, in a like manner, serve the chambers 17. Intake 21 and exhaust 22 valves control the communication between the intake passages 18 and exhaust passages 19 with the chambers 17 as is well known.

The engine 11 is provided with an induction system for serving the cylinder head intake passages 18. This induction system includes an air cleaner 23, a carburetor, indicated generally at 24, and an intake manifold, indicated generally at 25. The intake manifold 25 has a plenum chamber 26 that is in communication with the outlet end of the carburetor 24 and individual runners 27 that extend from the plenum chamber 26 to the individual cylinder head intake passages 18.

The carburetor 24 is of the two-barrel, stage type and includes a primary barrel 28 and a secondary barrel 29. A primary throttle valve 31 controls the flow through the primary barrel 28 and a secondary throttle valve 32 controls the flow through the secondary barrel 29. As is well known, the primary throttle valve 31 is appropriately connected to a throttle linkage for operator control of the speed of the engine 11. The secondary throttle valve 32 may be mechanically linked to the primary throttle valve 31 so as to be opened after a predetermined degree of the primary throttle valve 31. Alternatively, the secondary throttle valve 32 may be controlled by a vacuum motor or the like. Such throttle controls are well known in the art and form no part of this invention.

The primary barrel 28 is also provided with a choke valve 33 that is operated in any known manner, as by means of an automatic actuator, indicated generally by the reference numeral 34. A vacuum operated accelerating pump system, indicated generally by the reference numeral 35, is also provided for the primary barrel 28. This includes a discharge nozzle 36 and the associated components which are well known and, for that reason, will not be described in detail.

The construction of the engine 11 thus far described and the fuel system therefor is well known and, as has been previously noted, for that reason will not be described in any more detail.

The engine 11 is provided with a throttle positioning device, indicated generally by the reference numeral 37, for holding the primary throttle valve 31 in a partially opened position (as indicated by the dot-dash position in FIG. 2) under certain operating conditions, as will become apparent. The throttle positioning device 37 includes a vacuum motor comprised of an outer housing 38 which is divided by means of a diaphragm 39 into a vacuum chamber 41 and an atmospheric chamber 42. The atmospheric chamber 42 is vented in any suitable manner to the atmosphere, as by a vent passage 43. A coil compression spring 44 is positioned in the vacuum chamber 41 for normally urging the diaphragm 39 and components associated with it to a direction in which the primary throttle valve 31 can be maintained in its normal idle position.

A throttle operating member in the form of a rod 45 is affixed to the diaphragm 39 and extends through the atmospheric chamber 41 toward the body of the carburetor 24. The rod 45 is coupled to the throttle valve 31 in a manner best shown in FIG. 3, this connection being represented by the dot-dash line in FIG. 1.

A bellcrank 46 is pivotally supported on the carburetor body by means of a pivot pin 47. The rod 45 is operatively connected to one arm 48 of the bellcrank 46 in any known manner. A adjustable screw 49 is threaded into the other arm of the bellcrank 46 and is juxtaposed to a lever 51 that is affixed to the throttle valve shaft of the primary throttle valve 31. The lever 51 normally engages an adjustable screw 52 which determines the idle position of the primary throttle valve 31. A torsional spring 53 acts against the lever 51 to urge it into engagement with the screw 52. In this position the adjustable screw 49 is spaced from a tang 54 of the lever 51.

FIG. 3 illustrates the arrangement as it appears when the engine 11 is operating in a normal idle position and the throttle positioner 37 is not operative to adjust the positioning of the primary throttle valve 31. In this condition, the spring 44 urges the diaphragm 39 and rod 45 in such a direction that the bellcrank 46 is pivoted in a clockwise direction so that the screw 49 is spaced from the tang 54, as aforenoted. When conditions warrant repositioning of the throttle valve 31, a vacuum signal will be exerted in the chamber 41 in a manner to be described. When a predetermined vacuum is present in the chamber 41, the diaphragm 39 and rod 45 will be drawn downwardly. This will cause the bellcrank 46 to be pivoted in a counterclockwise direction so that the adjustable screw 49 is positioned to be engaged by the tang 54 and prevent the throttle valve 31 from moving to its normal idle position. Thus, the throttle valve 31 will be held in the dot-dash position as shown in FIG. 2. The exact degree of opening of the throttle valve 31 is controlled by adjustment of the screw 49 and adjustment of a stop 55 position within the diaphragm vacuum chamber 41.

In accordance with this invention, the vacuum signal for the actuator 37 is taken in the induction passage via a port 56 that is positioned closely adjacent the idle position of the throttle valve 31 and upstream of it. The port 56 is also preferably upstream of the partially opened position of the throttle valve 31 as it is controlled by the throttle positioner 37. The pressure signal from the port 56 is transmitted to the throttle positioner vacuum chamber 41 via a conduit 57, control device 58 and conduit 59. Ignoring, for the time being, the operation of the control device 58, it should be apparent that when the engine is operating at speeds above normal idle speeds that the throttle valve 31 will be opened sufficiently so that the port 56 is in effect downstream of it. Thus, the reduced pressure existent in the induction system will be transmitted through the port 56 to the vacuum chamber 41. Thus, the diaphragm 39 and rod 45 will be actuated so as to place the screw 49 in a position to be contacted by the tang 54 if the throttle valve 31 is suddenly closed. However, upon closure of the throttle valve 31, the port 56 will be upstream of the throttle valve 31 and sense atmospheric pressure. Thus, the pressure in the chamber 41 will be returned to atmospheric pressure and the diaphragm 39 and rod 45 will resume the position shown in FIG. 3 and the throttle 31 will be permitted to close. Thus, the device permits more accurate control of the throttle valve 31 and insures against its being held open for an unnecessarily long period of time and also against its being held open during times when such action is not necessary.

The control device 58 is arranged so as to control the rate of communication between the conduits 57 and 59 and, accordingly, the rate of transmission of pressure between the port 56 and the diaphragm vacuum chamber 41. In accordance with two illustrated embodiments of the invention, as shown in FIGS. 4 and 5, the control device 58 acts so as to provide different degrees of flow resistance in different directions. Specifically in these two embodiments there is a lesser degree of resistance of flow from the chamber 41 to the port 56 than in the opposite direction. As will become apparent, this delays the point at which the throttle positioner 37 is operative to hold the throttle valve 31 in an open position and return of the throttle valve 31 to its normal idle position will occur at a greater rate.

Referring first the the embodiment of FIG. 4, the control device 58 includes a pair of parallel passages 61 and 62 that interconnect the conduits 57 and 59. A fixed orifice 63 is provided in the conduit 61 and a fixed orifice 64 is provided in the conduit 62. The orifice 63 is smaller in effective area than the orifice 64. A check valve 65 in the conduit 61 is disposed so that the orifice 63 controls the communication of the flow from the diaphragm conduit 59 to the engine induction system conduit 57. An oppositely disposed check valve 66 is provided in the conduit 62 so that the orifice 64 controls the flow of air from the induction system conduit 57 to the diaphragm conduit 59.

The engine 11 is also provided with an auxiliary induction system for improving the performance at low engine speeds. The auxiliary induction system comprises an auxiliary intake passage 67 (FIGS. 1 and 2) which extends from an inlet 68 in a spacer 69 that is interposed between the intake manifold 25 and cylinder head 16. A control valve 71 is positioned in the spacer 69 for each cylinder head intake passage 18 and is effective, in a manner to be described, so as shunt the intake charge flow to the chamber 17 through the auxiliary induction system 67 under idle and low speed running. The auxiliary intake passage 67 has a discharge end 72 that is disposed closely adjacent each intake valve 18. The control valves 71 are coupled to the primary carburetor throttle valve 31 by means of a linkage system including a lost motion device, indicated schematically at 73. When the engine 11 is idling and the throttle valve 31 is in its idle position, the linkage operating the control valve 71 is such that they will be closed or substantially fully closed. The intake charge is thus shunted to the chamber 17 through the relatively small auxiliary intake passages 67 so that the charge will be delivered as a high velocity into the chamber 17. This high velocity insures good turbulence in the chambers and rapid flame propagation that has been found to significantly improve combustion efficienty at low speeds. As the primary throttle valve 31 is progressively opened, the lost motion device 73 will eventually cause the control valve 71 to open so that an increasing proportion of the charge will be delivered to the chambers through the main intake passages 27 and 18. The arrangement is such that the primary throttle valve 31 and control valves 71 will reach their fully opened position at approximately the same time.

Referring to the operation of the throttle positioning device 37 embodying the control unit 58 of the embodiment of FIG. 4, the figures show the arrangement in the idling condition. During idle, the port 56 will be positioned upstream of the idle position of the throttle valve 31 and atmospheric pressure will be transmitted to the vacuum chamber 41. The pressure in the chambers 41 and 42 will, therefore, be the same and the spring 44 will urge the diaphragm 39 and rod 45 to a position wherein the throttle positioning device 37 is not operative on the primary throttle valve 31, as has been previously described.

When the throttle 31 is opened sufficiently so that the port 56 is positioned on the downstream side of it and assuming intake manifold vacuum is high enough, the reduced pressure will be transmitted through the conduit 57 and opened check valve 65 and orifice 63 to the vacuum chamber 41. The orifice 63 is sized so that it will take at least ten seconds for the vacuum to build up in the chamber 41 to cause movement of the diaphragm 39 and rod 45 downwardly. After this time period has elapsed, the bellcrank 46 will have been rotated so that the adjustable screw 49 is positioned to be engaged by the tang 54 if the throttle valve 31 is suddenly released. Upon such sudden release of the throttle valve, the throttle valve 31 and its associated lever 51 will move rapidly toward their closed or idle positions. The tang 54 will, however, engage the screw 49 and the throttle valve 31 will be held in the dot-dash position as shown in FIG. 2. When this occurs, the port 56 will be positioned upstream of the throttle valve 31 and atmospheric pressure will again be exerted in the conduit 57. This atmospheric pressure will pass through the conduit 62 of the control device 57 through the now opened check valve 66 and orifice 64. The orifice 64 is sized so that the pressure in the chamber 41 will be returned to atmospheric at a faster rate than the vacuum was generated in this same chamber. In a preferred embodiment of the invention, the orifice 64 is sized so as to return the pressure to atmospheric in about three seconds. When this occurs, the spring 44 will again urge the diaphragm 39 to the position wherein the throttle valve 31 can move to its normal idle position.

By providing the delay in full closure of the throttle valve 31, it is insured that an excessively rich fuel-air mixture will not be drawn into the chamber 17 so as to cause unwanted exhaust gas emission and unnecessarily high fuel consumption. Also, since the control valves 71 will be fully closed during the decel condition, any charge introduced into the chamber 17 will flow through the auxiliary induction passages 67 so as to increase turbulence and improve efficiency during this running condition.

As has been noted, it is desireable to delay actuation of the throttle positioning device 37 so as to become effective for ten or more seconds. Another form of control device 58 for achieving the different rates of flow in shown in FIG. 5. In this embodiment, parallel conduits 81 and 82 interconnect the manifold conduit 57 with the diaphragm conduit 59. Fixed orifices 83 of the same flow resistance are positioned in each of the conduits 81 and 82. A check valve 84 is provided only in the conduit 81. The check valve is such that it will permit flow from the diaphragm conduit 59 to the manifold conduit 57 through the conduit 81 but will prevent flow in the reverse direction. Thus, when the port 56 is downstream of the throttle valve 31 due to a wide opening of this throttle valve, vacuum will be transmitted from the manifold conduit 57 to the diaphragm conduit 59 only through the control device conduit 82. The check valve 84 will prevent any flow through the conduit 81. On the other hand, under deceleration conditions when the throttle valve 31 is moved so that the port 56 is again exposed to atmospheric pressure, under this condition atmospheric air may bleed back to the diaphragm chamber 41 through both of the conduits 82 and 81 of the control device 58. Thus, atmospheric pressure is re-established more rapidly in the chamber 41 than vacuum was established in this chamber.

Various other arrangements may be provided for controlling the respective rates of communication between the induction system and the chamber 41. In some instances only a single orifice providing the same rates of communication in both directions may be employed. Various other types of control arrangements for achieving these relative flow rates will be readily apparent to those skilled in the art.

From the foregoing description it should be readily apparent that by providing the control signal for the throttle positioner 37 at a point which is just slightly upstream of the idle position of the throttle valve, it is possible to provide an arrangement wherein the throttle valve can be prevented from returning immediately to its idle position under extreme decel conditions. This insures against unnecessarily rich mixtures being drawn into the intake system which would adversely effect exhaust gas emissions as well as fuel economy. The arrangement, however, insures rapid closure of the throttle valve after a predetermined time delay so that smooth running can be insured and adequate engine braking provided without necessitating speed switches of the like. Furthermore, the use of the auxiliary induction system further improves operation both at idle and low speeds and under these decel conditions. The arrangement also insures against inadvertant operation of the throttle positioning device when the engine is being raced temporarily. It is also possible to insure against unnecessary operation of the throttle positioning device 37 during these engine racing conditions by making the resistance of the control device 58 sufficient to delay premature operation of this device.

It is to be understood that, in addition to the various embodiments and modifications disclosed, other modifications and variations may suggest themselves to those skilled in the art without department from the spirit and scope of the invention, as defined by the appended claims.

I claim:

1. A throttle control device for an internal combustion engine having an induction passage and a throttle valve in said induction passage, said control device comprising an operating member moveable between a normal position and an operative position, means operatively connecting said operating member to said throttle valve wherein said throttle valve may be positioned in a partially opened position when said operating member is in its operative position, a vacuum motor responsive to a sub-atmospheric pressure operatively connected to said operating member for moving said operating member from its normal position to its operative position when a sub-atmospheric pressure is exerted on said vacuum motor, and means for communicating said vacuum motor only with a point in said induction passage upstream of the idle position of said throttle valve for controlling said vacuum motor by the pressure at said point.

2. A throttle control device as set forth in claim 1 wherein the operative connection between the operating member and the throttle valve is such as to provide a variable stop for the closing movement of the throttle valve without interfering with the opening movement thereof.

3. A throttle control device as set forth in claim 1 wherein the means for communicating the vacuum motor with the induction passage includes means providing a restriction in the communication therebetween.

4. A throttle control device as set forth in claim 3 wherein a different degree of restriction is provided in the communication of the vacuum motor with the induction passage for flow from the induction passage to the vacuum motor than for flow from the vacuum motor to the induction passage.

5. A throttle control device as set forth in claim 4 wherein the different communication is provided by a control device having parallel flow paths interconnecting the vacuum motor with the induction passage, one of said flow paths being effective to control the flow from the vacuum motor to the induction passage and the other of said flow paths being effective to control the flow from the induction passage to the vacuum motor.

6. A throttle control device as set forth in claim 5 wherein the flow restrictions between the communication paths comprise fixed orifices and oppositely disposed check valves.

7. A throttle control device as set forth in claim 4 wherein a flow control device provides the variable communication between the induction passage and the vacuum motor, said flow control device comprising a pair of parallel flow paths therebetween and means for providing flow through one of said flow paths in one direction and both of said flow paths in the opposite direction.

8. A throttle control device as set forth in claims 1 or 3 wherein the means for providing communication between the vacuum motor and the induction passage comprises a port in the induction passage positioned upstream of the idle position of the throttle valve and downstream of the throttle valve when the throttle valve is opened substantially passed its idle position.

9. A throttle control device as set forth in claim 8 wherein the operative connection between the operating member and the throttle valve is such as to provide a variable stop for the closing movement of the throttle valve without interfering with the opening movement thereof.

* * * * *